US005453004A

United States Patent [19]

Hofbauer

[11] Patent Number: 5,453,004

[45] Date of Patent: Sep. 26, 1995

[54] METHOD FOR OPERATION OF AN OIL EVAPORATION BURNER AND AN OIL EVAPORATION BURNER FOR CARRYING OUT THE METHOD

[75] Inventor: Peter Hofbauer, Rösrath-Hoffnungsthal, Germany

[73] Assignee: Viessmann Werke GmbH & Co., Allendorf, Germany

[21] Appl. No.: 216,463

[22] Filed: Mar. 22, 1994

[30] Foreign Application Priority Data

Mar. 23, 1993 [DE] Germany ..... 43 09 115.6

[51] Int. Cl.[6] ..... F23N 5/00

[52] U.S. Cl. ..... 431/9; 431/12; 431/29; 431/281

[58] Field of Search ..... 431/9, 6, 12, 265, 431/264, 173, 29, 30, 31, 62, 287

[56] References Cited

U.S. PATENT DOCUMENTS

| | | | |
|---|---|---|---|
| 3,868,211 | 2/1975 | Haye et al. | 431/10 |
| 4,674,974 | 6/1987 | Godijn | 431/337 |
| 4,993,939 | 2/1991 | Fukuda et al. | 431/9 X |
| 5,147,200 | 9/1992 | Knopfel et al. | 431/11 |
| 5,249,955 | 10/1993 | Kuhn et al. | 431/264 X |

*Primary Examiner*—Larry Jones
*Attorney, Agent, or Firm*—Webb Ziesenheim Bruening Logsdon Orkin & Hanson

[57] ABSTRACT

The present invention is concerned with a method of operating an oil evaporation burner for heating boilers which, for NOX reduction, are operated with an exhaust gas return from the combustion chamber of the heating boiler into the burner.

In oil evaporation burners of the afore-described type the exhaust gas return during the start-up phase presents certain difficulties inasuch as the burner frequently goes off during the start-up phase. To overcome such difficulties the flow of exhaust gas as returned during the start-up phase is pneumatically discontinued by the formation of blocking curtains from air as supplied.

9 Claims, 3 Drawing Sheets

METHOD FOR OPERATION OF AN OIL EVAPORATION BURNER AND AN OIL EVAPORATION BURNER FOR CARRYING OUT THE METHOD

BACKGROUND OF THE INVENTION

1. Field of the Invention

The present invention relates to a method of operating an oil evaporation burner for heating boilers and, moreover, is concerned with an oil evaporation burner for carrying out the method.

2. Description of the Prior Art

A method of the afore-described type has been taught by U.S. Pat. No. 5,147,200 wherein under the pressurized supply of fresh air and under the admixture of exhaust gases returned to the burner the atomized liquid fuel is further dissolved in a swirl flow diverging in the out-flow direction. The burner used herefore comprises a housing on which is centrally provided the oil supply pen stock including a supply opening surrounding the latter for the introduction of fresh air, which pen stock is directed toward a funnel-type chamber for generating a swirl flow diverging in the out-flow direction and located within the housing on the side of the combustion chamber, with exhaust gas intake channels being provided on the funnel-type chamber and terminating in the said funnel in the area of injectors tangentially directed toward the funnel for introducing returned exhaust gases. This method and the appertaining burner enable the NOX emission values to be minimized even during the combustion of liquid fuels. However, in the practical use of the method it has been found that during the start-up phase of the burner, i.e. when operating temperatures do not yet prevail in the combustion chamber and on the burner, the latter, after ignition, frequently, goes off, so that it is difficult to bring it to continuous operation.

SUMMARY OF THE INVENTION

It is the primary object of this invention to provide an improved method and an oil evaporation burner for carrying out the method of the invention whereby the afore-mentioned start-up difficulties are avoided.

The above and other objects are accomplished according to the invention with a method which comprises the step of performing the return and introduction of the exhaust gases into the burner, basically, only after completion of the start-up phase of the burner. Most easily and preferably this is effected in that the supply of returned exhaust gases during the start-up phase is prevented by pneumatically generated blocking curtains of fresh air.

It has been found that after ignition of the atomized or quasi vaporized fuel the combustion during the start-up phase can be easily maintained and that the burner kept in continuous operation can be passed over to the normal operating phase at operating temperatures then attained in the combustion chamber of the heating boiler and on the burner which temperatures are largely constant.

The exhaust gas return during the start-up phase is prevented by "actuable means", i.e. from ignition of the burner the exhaust gas supply remains discontinued by such means until normal operating temperatures are reached whereafter the said means are operated and opened, respectively through sensor or time control units to maintain the exhaust gas supply for the full duration of the normal operating phase. This operation is not effected by mechanically operable slides or valves susceptible to trouble that are provided on or in the channels for the exhaust gas return but rather, in the practice of the invention, by a design of the burner in which the switch-off means on the exhaust gas intake channels are in the form of fresh air supply channels provided on the exhaust gas intake channels, with the latter being furnished with fresh air blow-off openings terminating across the exhaust gas intake channels. In this way, the exhaust gas flow admitted under injector effect and returned from the combustion chamber is quasi hampered by a blocking curtain of fresh air put across its path of flow, thereby largely preventing the exhaust gas from being introduced and at the same time insuring the additional supply of fresh air during the start-up phase. To insure the supply of fresh air for forming the blocking curtain, a small demand-controllable blower, i.e. a blower able to be turned on and off, can be provided externally, i.e. ahead of the burner; however, it is also possible to branch conduits openable and closeable from the pressure channel of the burner blower for the formation of the blocking curtains, and lead same to the fresh air channels, with the regulating means for opening and closing being located ahead of the actual burner, so that they are not exposed to high temperatures.

Hence, it is of decisive importance for the fact that an oil evaporating burner of the afore-mentioned type can also be successfully used for heating boilers with an exhaust gas return that do not only operate continuously but for fuel saving purposes are turned on and off more or less frequently in a demand-controlled way, that, on the one hand, the exhaust gas return during the respective start-up phases be prevented and, on the other hand, the said prevention of the exhaust gas return be not effected by mechanical means but rather pneumatically by means of blocking curtains of fresh air which can be controlled, i.e. turned on and off, externally of temperature-critical zones by mechanical means.

Although it is known from U.S. Pat. No. 3,868,211 to control or throttle returned amounts of exhaust gas, the prior art is only concerned with influencing the flame temperarture for NOX reduction rather than with the problem of maintaining the process of combustion during the start-up phase. In addition, throttling of the returned exhaust gases more or less hot is directly caused by a sleeve-type mechanically operated slide. Incidentally, the exhaust gases to be returned first are withdrawn from the flue gas outlet of the heating boiler and outside the boiler are led through a return conduit to the burner.

BRIEF DESCRIPTION OF THE DRAWING

The above and other features, objects and advantages of this invention will become apparent from the following detailed description of preferred embodiments, taken in conjunction with the accompanying somewhat schematical drawing, wherein.

DETAILED DESCRIPTION OF PREFERRED EMBODIMENTS

Figure 1:
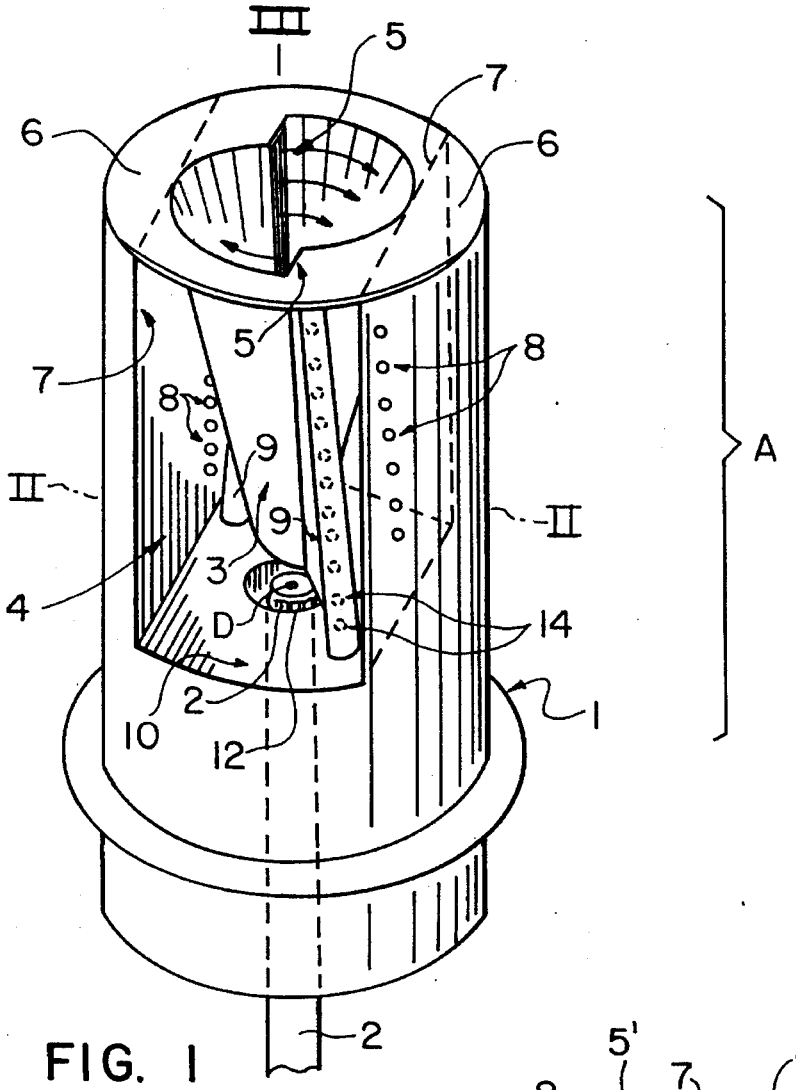
FIG. 1 is a perspective view showing the burner.
Figure 2:
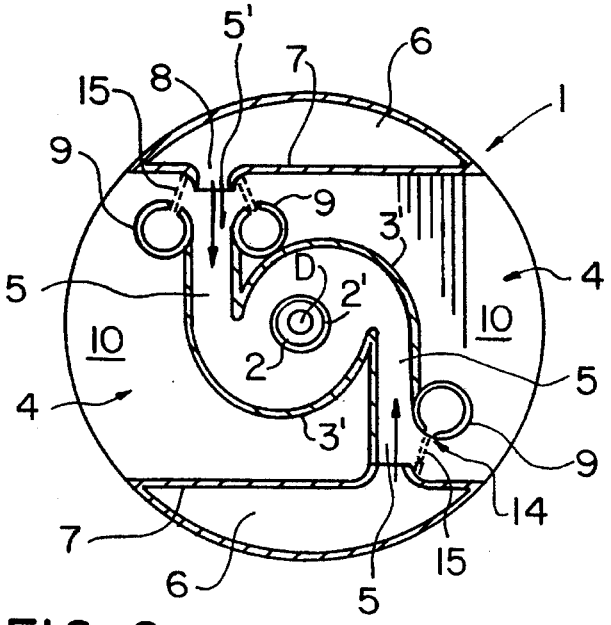
FIG. 2 is a sectional view of the burner taken along line II—II of FIG. 1.
Figure 3:
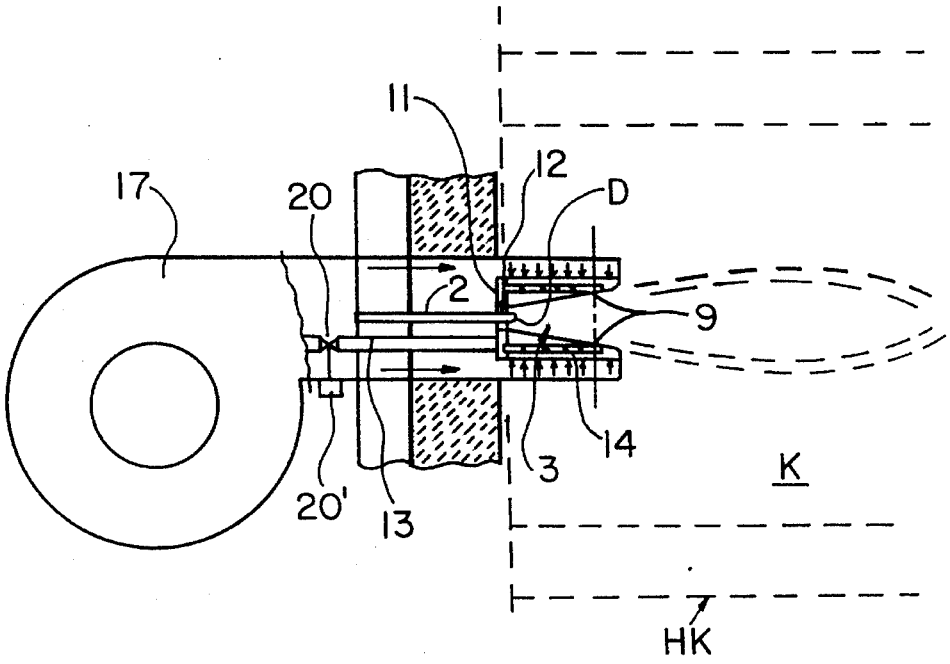
FIG. 3 is a sectional view of the burner, taken along line III—III of FIG. 1, which is arranged at the door of a boiler.

Now, referring to the drawing and first to FIGS. 1, 2 and 3, there is shown an oil evaporation burner comprising a housing 1 on which is centrally provided the oil supply conduit 2 including the nozzle D. Air for the combustion of the oil finely atomized, i.e. quasi evaporated through the nozzle D, is supplied through the opening 2' in which the oil supply conduit 2 extends coaxially and mainly through the injectors 5.

The nozzle D is provided in a conical funnel 3 open at the top and bottom and comprising two zones in the form of injectors 5, i.e. the said injectors 5 are provided in the wall 3' of the funnel 3. The complete section A of the burner protrudes into the combustion chamber K (see FIG. 3) of the boiler HK only shown in contours. As clearly shown in FIG. 1, the funnel 3 is located in shaft 4 of the housing 1 open on two ends. The said shaft 4 is confined by two air chambers 6 the internal walls 7 of which are provided with air discharge openings 8 in registry with the in-flow openings 5' of the two injectors 5. Provided on the two injectors 5 are tubes 9 arranged in a correspondingly oblique way and being in communication with the bottom 10 of the shaft 4 which is in the form of an air chamber 11 (see FIG. 3) provided with a small passage channel 12 for the oil supply conduit 2. Connected to the said air chamber 11 is an air supply conduit 13 through which is supplied air for forming the blocking curtains 15 on the injectors 5 during the start-up phase of the burner as will be explained in closer detail hereinafter.

The air flowing at a high speed out of the air discharge openings 8 and flowing into the in-flow openings 5' of the injectors 5 causes a vacuum to be formed on the in-flow openings 5' through which a part of the gases is sucked into the shaft 4 of the burner and, hence, into the injectors 5, i.e. a mixture of air and exhaust gas flows from the injectors 5 into the funnel 3 where it forms a swirl flow surrounding the oil mist as formed by the nozzle D and burning, with the swirl flow mixing with the flame and reducing the flame temperature. These conditions apply to continuous operation.

During the start-up phase of the burner, i.e. until normal operating temperatures prevail in the combustion chamber K and on the burner itself, air is supplied under pressure through the air supply conduit 13 to the air chamber 11 which is passed through the chamber 11 into the tubes 9 and which flows off through the openings 14 thereof into the injectors 5 where it forms the blocking curtains 15 as shown in dotted lines in FIG. 2. The said blocking curtains 15 largely prevent the supply of exhaust gas thereby enabling the flame to burn during the start-up phase.

Once the two injectors 5 are open on both sides as shown in FIG. 2 to the left at the top, tubes 9 are provided on both sides of the injector 5. However, if by way of alternative the injectors 5 are open on one side only as shown to the right at the bottom, then only one tube 9 will be provided.

Figure 4:
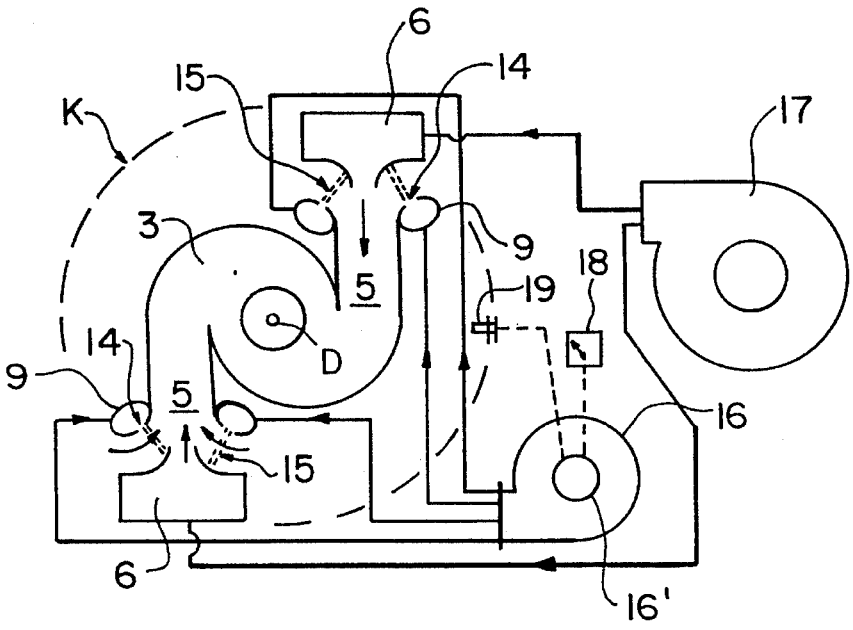
FIG. 4 schematically shows a sectional view of a form of embodiment of the burner including a separate fresh air blower for the formation of the blocking curtains.
Figure 5:
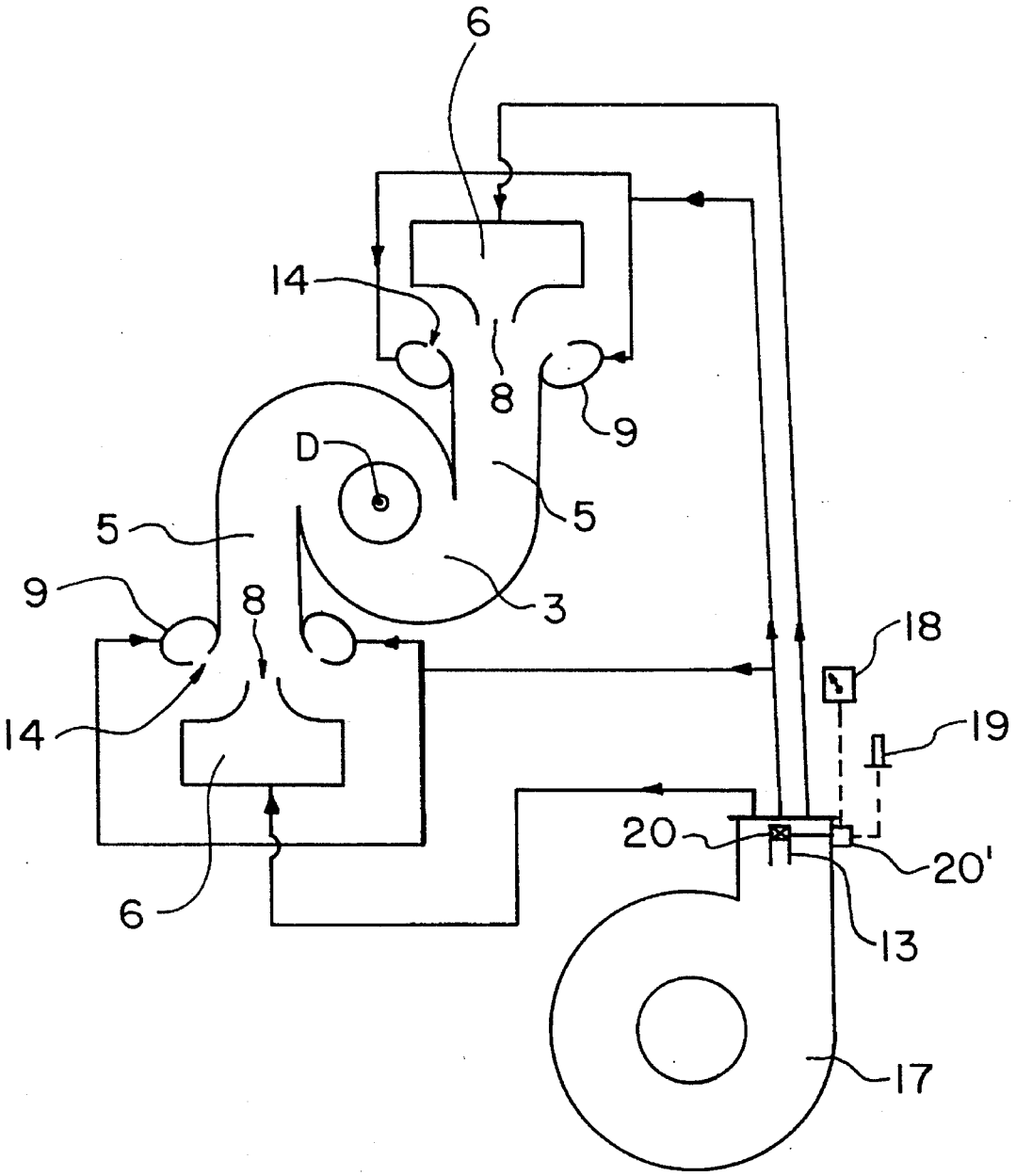
FIG. 5 schematically shows a sectional view of another form of embodiment of the burner with a valve-controlled fresh air supply for the formation of the blocking curtains.

As regards the controlled air supply to the tubes 9, reference is made to FIGS. 4 and 5 schematically showing the burner with the control elements. In the examples of embodiment according to FIG. 4 a small separate yet adequately pressurizing blower 16 is provided for the air supply which is turned on upon actuation of the burner and of the burner blower 17. The drive 16' of the said blower 16 is in communication either with a timer 18 or with a thermosensor 19 located in the combustion chamber K.

After a period determined by the duration of the start-up phase of the burner, the timer 18 turns off the blower 16.

Should a thermosensor 19 be provided the blower would be turned off by thermosensor 19 as soon as normal operating temperatures prevail in the combustion chamber K and on the burner.

In the form of embodiment according to FIG. 5, the air supply conduit 13 (also see FIG. 3) is provided with a valve 20 open during the start-up phase of the burner so that air can be passed through the said air supply conduit 13 also into the air chamber 11 and, hence, into the tubes 9. The said valve 20 provided with a servo drive 20' which is located outside changing temperature zones of the burner is also in communication with a timer 18 or thermosensor 19 of the type as shown in FIG. 4 and is closed by the said units at the end of the start-up phase.

What is claimed is:

1. A method of operating an oil evaporation burner comprising the following steps:

actuating the burner for the purpose of supplying combustion air and fuel under pressure;

atomizing and igniting the fuel in the burner;

introducing the air through injectors into the burner;

introducing a separate air flow while forming blocking curtains for preventing the take-in of exhaust gas from the combustion chamber;

discontinuing the separate air flow at the end of the start-up phase and maintaining the supply of combustion air and fuel for the operating period of the burner following the start-up phase.

2. An oil evaporation burner, which comprises:

a housing partly open to the outside and provided with a conical funnel located therein and being open at the top and bottom;

a fuel supply conduit having a nozzle directed toward the funnel;

at least one injector provided in the wall of the funnel;

at least one air chamber within the housing which is in communication with a blower and which contains air discharge openings directed toward the injector;

at least one tube provided on the injector and containing air discharge openings directed cross-wise toward the injector, which tube is in communication with an air supply conduit; and means for the controlled discontinuation of the air supply to the tube at the end of the start-up phase of the burner.

3. An oil evaporation burner according to claim 2, wherein two diagonally opposed injectors each having an in-flow opening and at least one tube are provided on the funnel, and an air chamber having air discharge openings being associated to each injector, with said air chambers confining a shaft within the housing open toward two sides.

4. An oil evaporation burner according to claim 3, wherein the injectors are open at both sides toward the shaft and one tube each is arranged on both sides of each in-flow opening of the injectors.

5. An oil evaporation burner according to claim 3, wherein the injectors are open on one side toward the shaft and a tube is provided on the in-flow openings of the injectors.

6. An oil evaporation burner according to claim 3, wherein the tubes are in communication with an air chamber forming the bottom of the shaft, connected to which air supply chamber is an air supply conduit, with the said air supply chamber being provided with a centric passage channel for the fuel supply conduit.

7. An oil evaporation burner according to claim 2, wherein the air supply conduit for the at least one tube is provided with a separate blower the drive of which is in switch contact with a timer or a thermosensor.

8. An oil evaporation burner according to claim 2, wherein the air supply conduit for the at least one tube is in communication with the blower for the supply of combustion air of the burner and the air supply conduit is provided with a valve the drive of which is in switch contact with a timer or a thermosensor.

9. An oil evaporation burner, comprising:

means for actuating the burner for the purpose of supplying combustion air and fuel under pressure;

means for atomizing and igniting the fuel in the burner;

means for introducing the air through injectors into the burner; means for introducing a separate air flow while forming blocking curtains for preventing the take-in of exhaust gas from the combustion chamber; and means for discontinuing the separate air flow at the end of the start-up phase and maintaining the supply of combustion air and fuel for the operating period of the burner following the start-up phase.

* * * * *